US006158686A

United States Patent [19]

Lawrence

[11] Patent Number: 6,158,686

[45] Date of Patent: Dec. 12, 2000

[54] DEVICE FOR QUICK COILING AND WRAPPING OF WIRE AND OTHER FLEXIBLE STRAND MATERIALS

[76] Inventor: Jeff Lawrence, 8408 Stapleton Ave., Las Vegas, Nev. 89128

[21] Appl. No.: 09/451,517

[22] Filed: Nov. 30, 1999

[51] Int. Cl.[7] ..... B65H 75/34

[52] U.S. Cl. ..... 242/405.2; 242/129; 242/578.2; 242/588

[58] Field of Search ..... 242/405.2, 405.3, 242/129, 578, 578.2, 578.1, 588, 588.1

[56] References Cited

U.S. PATENT DOCUMENTS

| | | | |
|---|---|---|---|
| 325,394 | 9/1885 | Cavalli | 242/129 |
| 1,085,729 | 2/1914 | Gore | 242/405.2 X |
| 1,728,106 | 9/1929 | Collins . | |
| 2,644,650 | 7/1953 | Burke, Jr. | 242/129 |
| 2,709,028 | 5/1955 | Cottar | 242/405.2 X |
| 4,177,961 | 12/1979 | Gruenewald . | |
| 4,277,035 | 7/1981 | Gaski | 242/405.2 X |
| 4,437,625 | 3/1984 | VanSickle | 242/129 |
| 4,475,698 | 10/1984 | Militello | 242/405.3 X |
| 4,586,675 | 5/1986 | Brown . | |
| 4,811,918 | 3/1989 | Grooms | 242/588 X |
| 5,560,564 | 10/1996 | Maynard | 242/588 X |
| 5,816,524 | 10/1998 | Opal | 242/578.2 X |

*Primary Examiner*—Donald P. Walsh
*Assistant Examiner*—Collin A. Webb
*Attorney, Agent, or Firm*—Frank Frisenda

[57] ABSTRACT

An improved device is provided for quick coiling and wrapping of wire or other flexible strand materials such as ropes, cables, hose or the like. In a presently preferred form, the device comprises a handle portion and a base portion, the base portion having an elongated body carrying two substantially parallel spaced laterally adjustable carrier arms protruding from the elongated body to securely hold the coil of flexible strand material in place on the device until the coil is wrapped and/or removed. The handle portion of the device is provided with a hand grip for conveniently gripping the device as the flexible material is wound thereon and an adjustment mechanism of for selecting the desired length of the elongated body.

7 Claims, 3 Drawing Sheets

DEVICE FOR QUICK COILING AND WRAPPING OF WIRE AND OTHER FLEXIBLE STRAND MATERIALS

BACKGROUND OF THE INVENTION

The present invention relates to an improved device for quick coiling and wrapping of wire or other flexible strand materials such as ropes, cables, yarn, hose or the like.

With the ever increasing use of electrical, communications and computer products there is a growing need for compactness and storage of attendant cables, electrical wire and telephone cords. The effective coiling and wrapping of such flexible strand materials is not only desirable from an appearance standpoint but can also enhance safety by minimizing risks which may be posed by tangling of excessive lengths of cables and/or by exposure of electrical wire to adverse environmental conditions such as standing water. Moreover, compact placement and storage of strand materials, e.g., electrical wire and telephone cable, is desirable to prevent interference with persons working, standing or walking in close proximity to such strand materials.

A number of conventional devices for storage and reeling of lines, cable or the like are known to the art.

For instance, U.S. Pat. No. 2,423,533 entitled "Winding Appliance" discloses a winding appliance for use in winding by hand a yarn package of elongated or oval contour as distinguished from the usual ball shaped package.

U.S. Pat. No. 2,470,658 entitled "Reel Assembly" discloses a device related to reel assemblies by means of which the reel or other object may be supported upon an arm of an individual with the other hand free.

U.S. Pat. No. 2,582,787 entitled "Electric Cord Housing" discloses an invention related to housings for excess electric cord between a portable piece of electric equipment and the outlet. The principal object of the invention is to provide a housing which will store a variable and chosen amount of the excess wire or cord and thus avoid abrasion or kinking of the balance of the electric light cord.

U.S. Pat. No. 2,747,812 entitled "Device for Storing Lines" discloses a device for storing lines wherein one end of the line is held or fixed and the other end of the line is to be case out.

U.S. Pat. No. 3,612,426 entitled "Extension Cord Caddy" discloses a storage means for electric cords such as extension cords and more particularly to holders for storing such cords in a coiled condition.

U.S. Pat. No. 4,261,529 entitled "Device for Winding and Storage of Ropes and the Like" discloses a device for winding and storage of ropes, cables, wires, etc., comprising a substantially elongate body portion having a pair of horn-like members extending from opposite ends thereof.

U.S. Pat. No. 4,779,817 entitled "Hand Winder" discloses a hand winder for winding and unwinding a line, cable or the like comprises a handle portion and a carrier portion for carrying the line or cable.

Other devices for coiling and storage of electric cords and the like are disclosed, for instance, in U.S. Pat. Nos. 4,277,035, 5,348,240, 5,615,509 and 5,145,122.

While generally providing support for coiling and/or storing excess lengths of flexible strand materials, such conventional devices are somewhat limited in their effectiveness for a host of strand materials having varying diameters and flexibility. Accordingly, those skilled in the art have recognized a significant need for an improved device for quick coiling and wrapping of wire or other flexible stand material that is readily adjustable to provide a device capable of supporting flexible strand materials having a wide range of dimensions. The present invention fulfills these needs.

SUMMARY OF THE INVENTION

An improved device is provided for quick coiling and wrapping of wire or other flexible strand materials such as ropes, cables, hose or the like. In a presently preferred form, the device comprises a handle portion and a base portion, the base portion having an elongated body carrying two substantially parallel spaced laterally adjustable carrier arms protruding from the elongated body to securely hold the coil of flexible strand material in place on the device until the coil is wrapped and/or removed. The handle portion of the device is provided with a hand grip for conveniently gripping the device as the flexible material is wound thereon and an adjustment mechanism of for selecting the desired length of the elongated body.

One suitable mechanism for effecting such adjustment is a ratchet and spring mechanism contained within the handle portion of the device. Each carrier arm is preferably laterally adjustable to the desired length that the arm protruded from the elongated body to provide a mounting means to securely hold the coil of flexible strand material in place on the device until the coil is wrapped and removed for further use. Such lateral adjustment of the carrier arm may be effected by a collar and wing nut through which the carrier arm is slidably disposed therein.

DETAILED DESCRIPTION OF THE PREFERRED EMBODIMENT

An improved device is provided for quick coiling and wrapping of wire or other flexible strand materials such as ropes, cables, hose or the like. In a presently preferred form, the device comprises a handle portion and a base portion, the base portion having an elongated body carrying two substantially parallel spaced laterally adjustable carrier arms protruding from the elongated body to securely hold the coil of flexible strand material in place on the device until the coil is wrapped and/or removed. The handle portion of the device is provided with a hand grip for conveniently gripping the device as the flexible material is wound thereon and an adjustment mechanism of for selecting the desired length of the elongated body.

Figure 1:
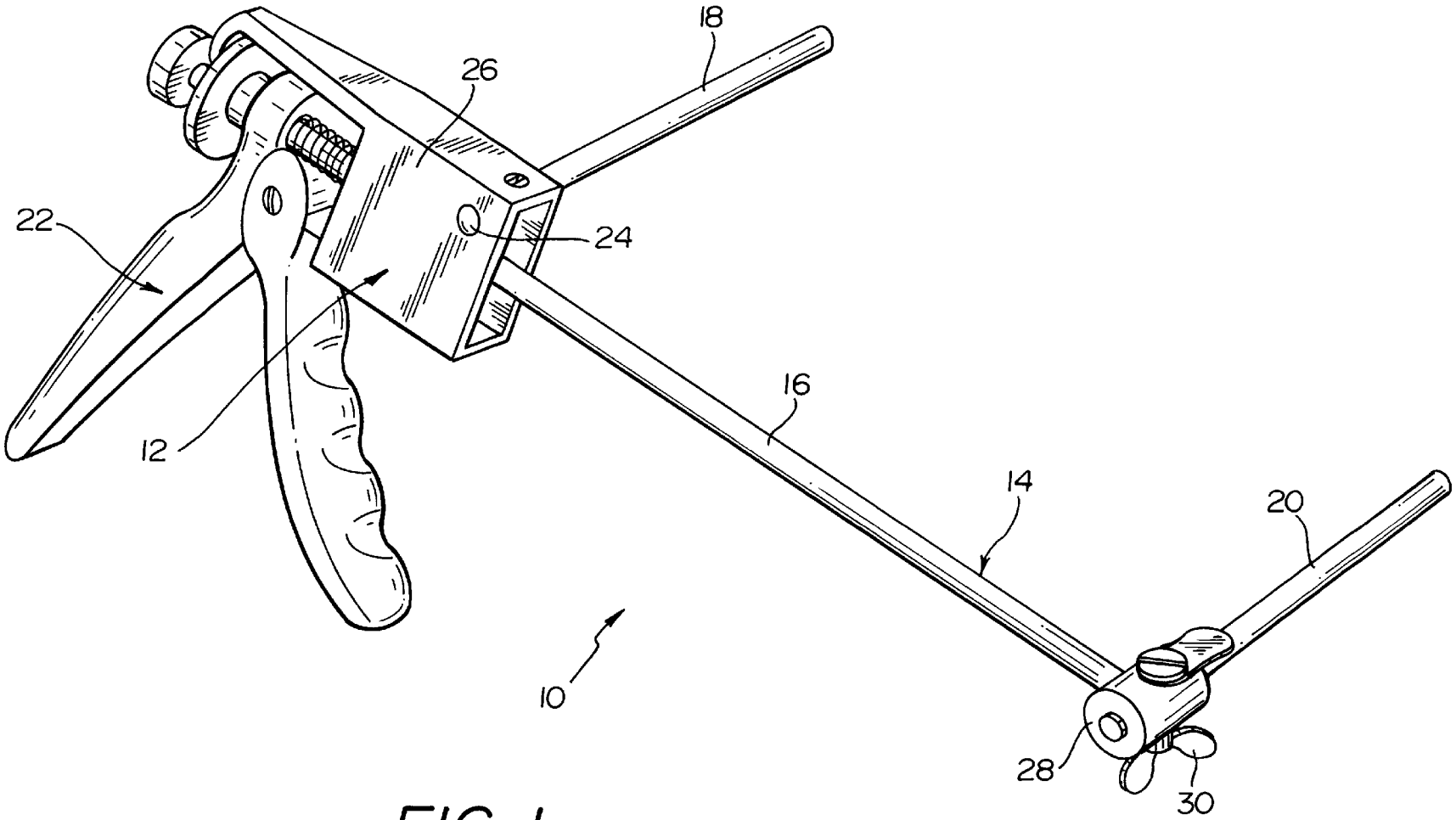
FIG. 1 is a perspective view of one embodied form of a device for quick coiling and wrapping of wire and other flexible strand materials in accordance with the present invention.

Referring now to FIG. 1, there is depicted one embodied form of the improved device for quick coiling and wrapping of wire or other flexible strand materials in accordance with the present invention. In a presently preferred form, the device 10 comprises a handle portion 12 and a base portion

Figure 2:
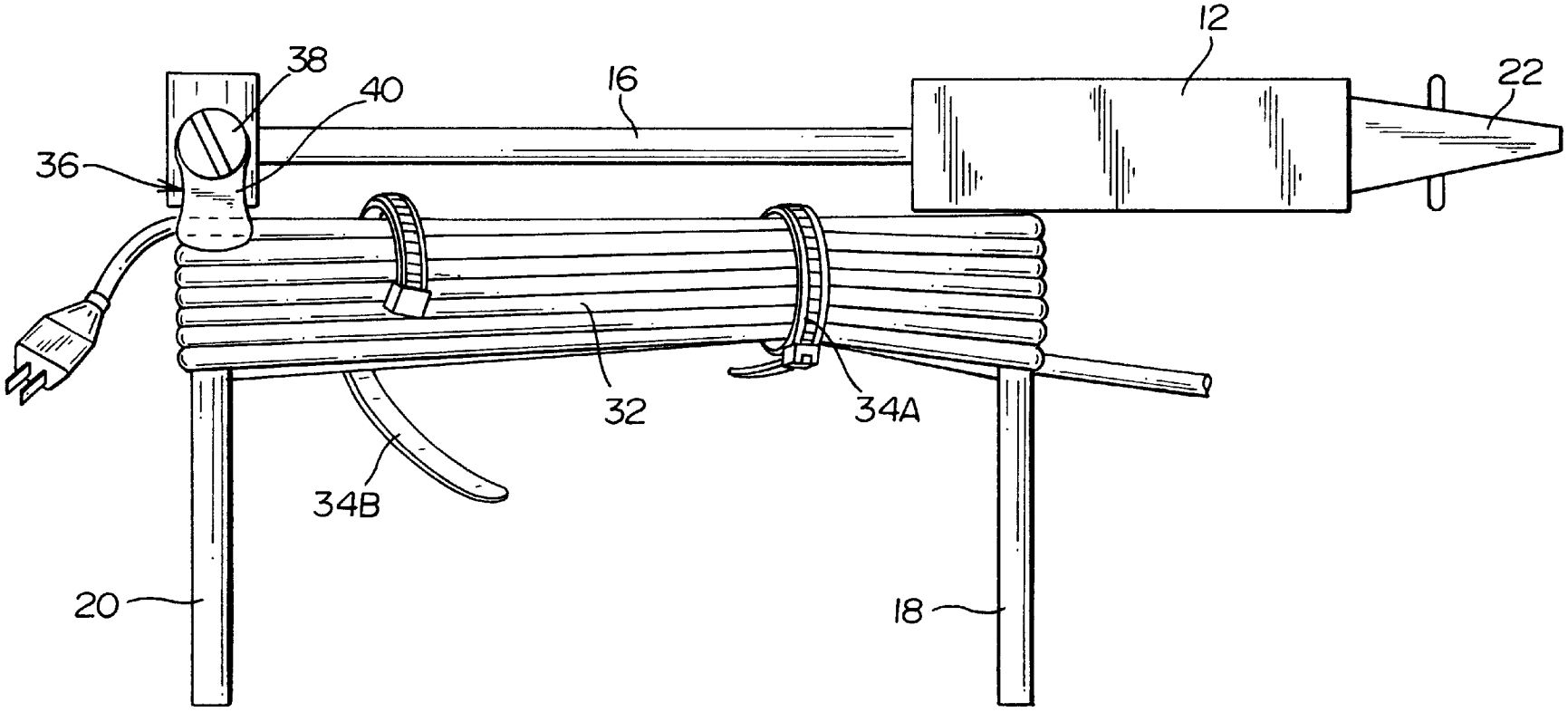
FIG. 2 is a top view of the inventive device depicted in FIG. 1 and further illustrating a coiled wire held in place on the device during wrapping.

14 having an elongated body 16 carrying two substantially parallel spaced adjustable carrier arms 18 and 20 protruding from the elongated body 14 to securely hold a coil of flexible strand material in place on the device 10 until, for instance, the coil is wrapped to be removed for further use. The handle portion 12 of the device 10 may be provided with a hand grip 22 for manually gripping the device 10 as the flexible material is wound thereon, and to provide for adjustment of the length of the elongated body. One suitable mechanism for effecting such adjustment is a ratchet and spring mechanism contained within the handle portion of the device 10. The base portion 14 of the device 10 as shown in FIGS. 1 and 2 may generally take the shape of a rod, post or other elongated rigid support for carrying the two substantially parallel spaced carrier arms 18 and 20 that protrude from the base 14. Each carrier arm 18 and 20 is preferably laterally adjustable to select and fix the length that the arm protrudes from the base 14. Such lateral adjustment of the carrier arm may be effected by sliding the carrier arm 18 through a bore 24 disposed in the handle housing 26. A set screw (not shown) may be threaded through the top portion of the housing 26 to fix the position of the carrier arm 18. Similarly, carrier arm 20 is slidably mounted within a collar 28 provided on the distal end of the elongated body 16. A wing nut 30 may be rotated to tighten the collar 28 and fix the length of the carrier arm 20.

Referring now to FIG. 2, the device 10 is shown in a top view. Supported on the carrier arms 18 and 20 is a coiled electrical cord 32 for wrapping, for instance, by plastic ties 34(*a*) and 34(*b*). Also depicted is a rotatable fastening means 36 for temporarily securing the terminal end of the electrical cord 32 is hold the cord in position for coiling and wrapping operations. The rotatable securement means 36 includes a retaining screw 38 for movably holding a plastic tab 40 under which the cord 32 is restrained.

Figure 3:
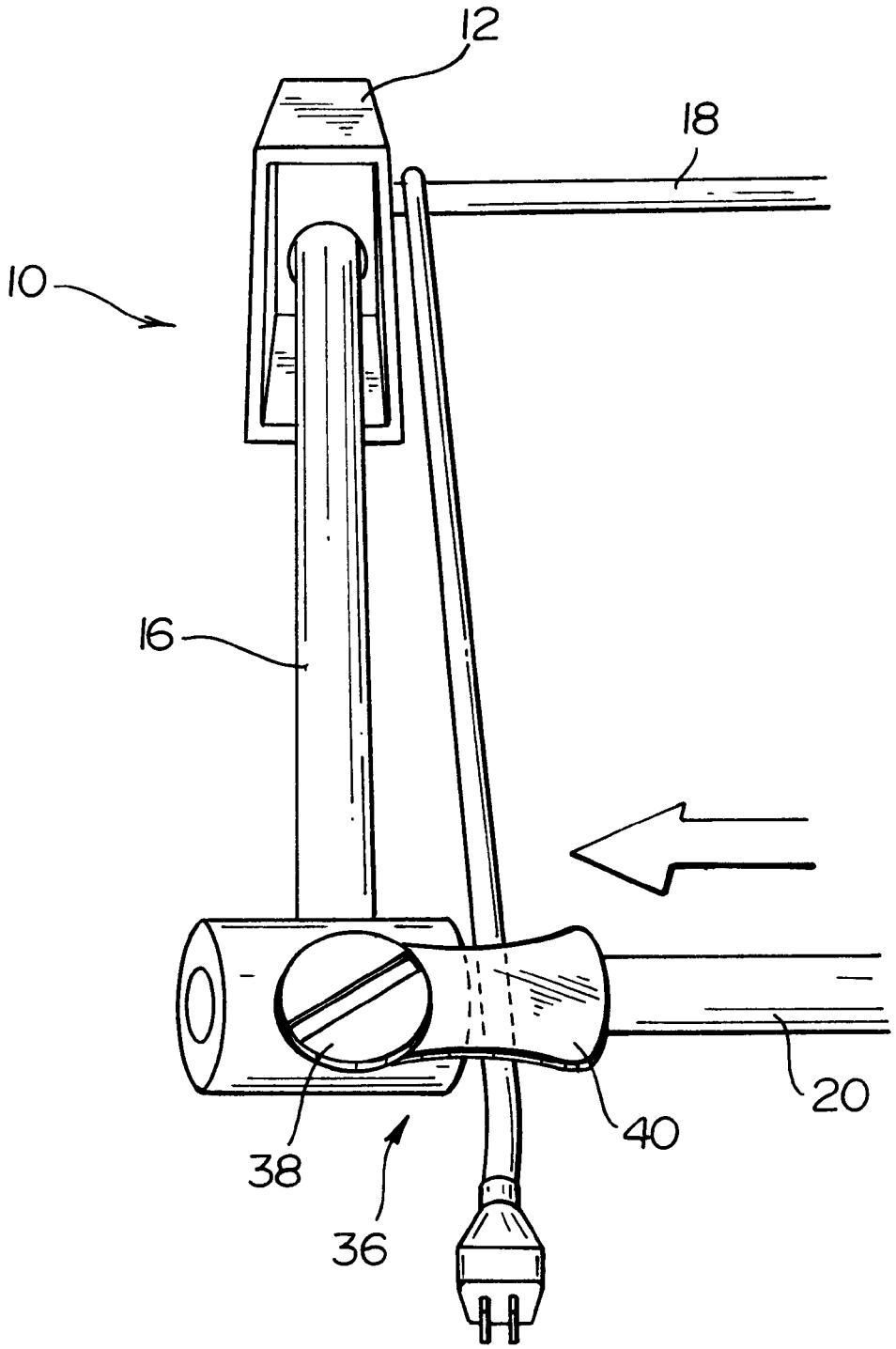
FIG. 3 is a front perspective view of the elongated body of device depicted in FIG. 1 further illustrating one embodied means for removably securing an end portion of an electrical cord to be coiled around two substantially parallel spaced adjustable carrier arms in accordance with one embodied form of the present invention.

FIG. 3 is an enlarged fragmentary view of the front perspective view of the device 10 showing further detail of the rotatable securement means 36. As shown, the terminal end of the electrical cord 32 is placed under the flexible tab 40 to secure the length of cord while the remaining length of cord is wrapped around supporting arms 18 and 20.

In accordance with the present invention, the device 10 may be fabricated from suitable rigid materials such as metal, wood, plastic or combinations thereof. The present invention thus provides support for coiling and/or storing excess lengths of flexible strand material having varying diameters and flexibility. The unique device is readily adjustable to provide coiling support of ropes, cables, hose or the like, having a wide range of dimensions.

What is claimed is:

1. A device for quick coiling and wrapping of wire or other flexible strand materials, the device comprising a handle portion and a base portion, said base portion having an elongated body carrying two substantially parallel spaced laterally adjustable carrier arms protruding from the elongated body to hold the coil of flexible strand material in place on the device; said handle portion including means for adjusting the length of said elongated body wherein said adjustment means provided in said hand grip is a ratchet and spring mechanism.

2. The device for quick coiling and wrapping of wire as defined in claim 1, wherein said handle portion further comprises a hand grip for manually gripping the device as flexible material is wound thereon.

3. The device for quick coiling and wrapping of wire as defined in claim 2, wherein said hand grip further comprises means for adjusting the length of the elongated body.

4. The device for quick coiling and wrapping of wire as defined in claim 1, wherein each carrier arm is laterally adjustable to select and fix the length that the arm protrudes from the base portion.

5. The device for quick coiling and wrapping of wire as defined in claim 4, wherein said lateral adjustment of the carrier arm is effected by sliding the carrier arm through a bore disposed in the handle housing.

6. The device for quick coiling and wrapping of wire as defined in claim 5, and further comprising a set screw threaded through the top portion of the handle housing to fix the position of the carrier arm.

7. The device for quick coiling and wrapping of wire as defined in claim 6, wherein one of the carrier arms is slidably mounted within a collar provided on the distal end of the elongated body.

* * * * *